United States Patent [19]

Cump

[11] Patent Number: 5,014,925

[45] Date of Patent: May 14, 1991

[54] REEL ASSEMBLY AND METHOD FOR LOADING A REEL

[76] Inventor: Charles Cump, 261 Shore Ct., Burr Ridge, Ill. 60521

[21] Appl. No.: 310,627

[22] Filed: Feb. 15, 1989

[51] Int. Cl.[5] ..... B65H 75/38

[52] U.S. Cl. ..... 242/86; 242/96

[58] Field of Search ..... 242/85, 86, 86.1, 86.2, 242/86.3, 86.4, 96, 115, 116; 137/355.16, 355.17, 355.18, 355.19, 355.26

[56] References Cited

U.S. PATENT DOCUMENTS

| | | | |
|---|---|---|---|
| D. 286,610 | 11/1986 | Brusadin | 242/85 X |
| D. 299,618 | 1/1989 | Drought et al. | 242/86 X |
| 3,484,979 | 12/1969 | Wonsch | 242/96 X |
| 3,779,478 | 12/1973 | Fugate | 242/86 |
| 4,195,794 | 4/1980 | Ricci et al. | 242/96 |
| 4,200,249 | 4/1980 | Synstelien et al. | 242/96 |
| 4,251,038 | 2/1981 | Gename | 242/86 |
| 4,306,688 | 12/1981 | Hechler, IV | 242/86 |
| 4,484,718 | 11/1984 | Jones-Fenleigh | 242/86 |
| 4,531,686 | 7/1985 | Shaw | 242/96 |
| 4,537,215 | 8/1985 | Roman | 137/355.26 |

FOREIGN PATENT DOCUMENTS

| | | | |
|---|---|---|---|
| 923868 | 4/1973 | Canada | 242/96 |
| 2164631 | 3/1986 | United Kingdom | 242/86 |

*Primary Examiner*—Katherine Matecki

*Attorney, Agent, or Firm*—Martin Faier

[57] ABSTRACT

A low friction reel assembly for winding, storing and transporting a length of material, such as garden hose, wherein a pair of concentrically arranged removably secured spaced apart wall sections bridge and extend outwardly radially from a central body to define a channel for confining the length of material wound therein, one end of the material being held in the body, and a handle integral with one wall section which at its center supports the reel for rotation and on its periphery slidably engages the other wall section during its rotation, the engaged wall and body being rotatable relative to the handle in one direction for winding up the length of material and in a reverse direction for unwinding the material. The invention also includes a method for loading the reel assembly which includes the steps of engaging one wall section open on its face and the central body on a fixture, winding the material on the body, and interlocking the other wall section over the first section and body to close the reel after the material has been wound therein.

16 Claims, 2 Drawing Sheets

FIG. 5
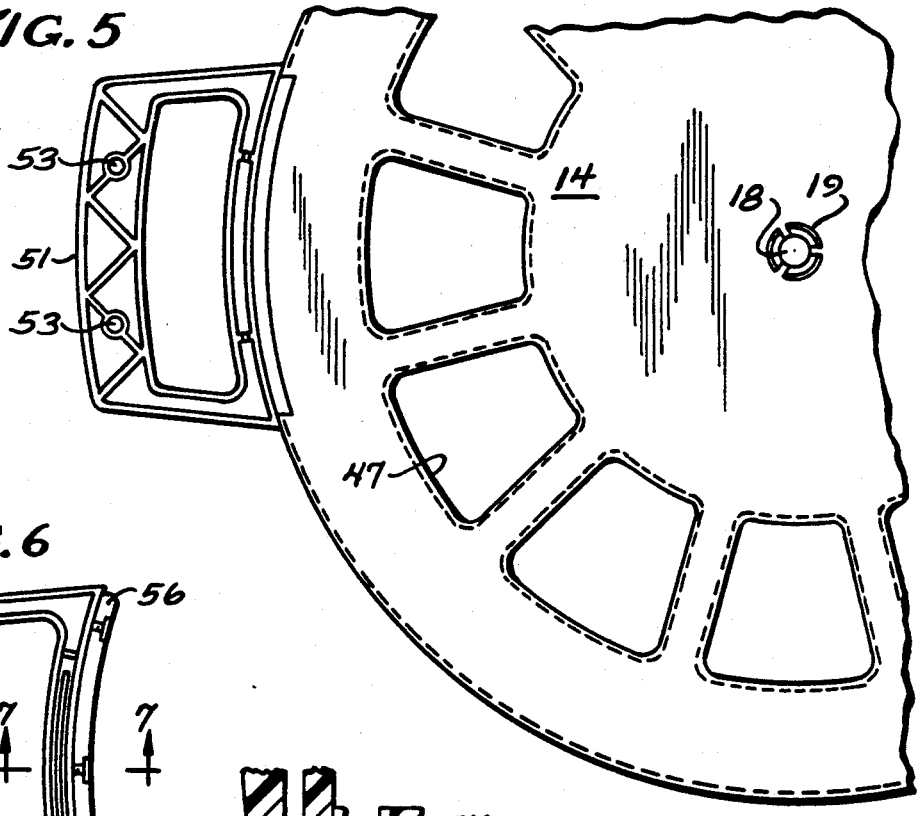
FIG. 6
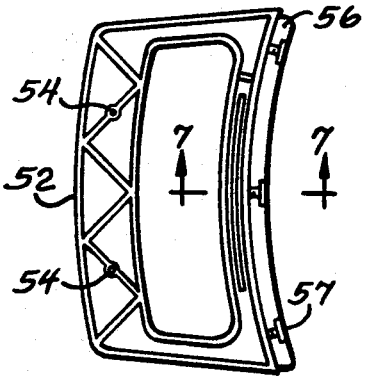
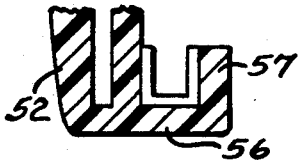
FIG. 7
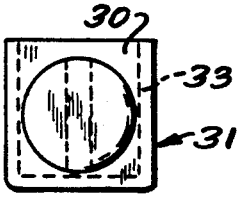
FIG. 10
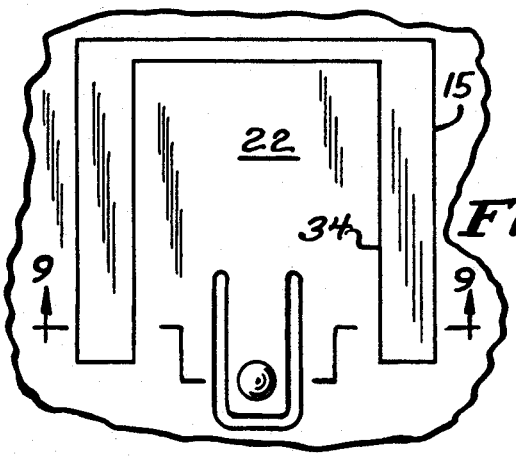
FIG. 8
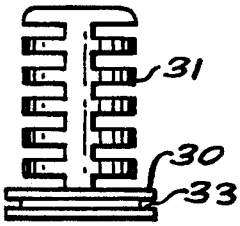
FIG. 11
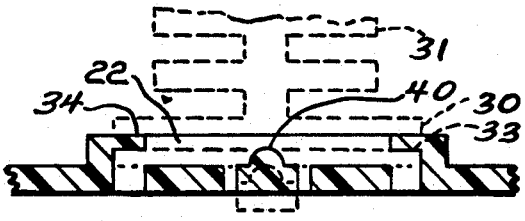
FIG. 9

REEL ASSEMBLY AND METHOD FOR LOADING A REEL

BACKGROUND AND SUMMARY OF THE INVENTION

This invention relates to a reel assembly, a method for assembling reel sections together and a method for winding a length of material on a reel assembly. The invention is more particularly concerned with such a device and methods which are suitable for winding a length of hose or similar material on a reel assembly during fabrication and for assembling the reel sections together.

When exposed to an outdoor, wet or adverse environment, it is desirable that a device embodying the present invention should be fabricated from plastic material, which may be molded and does not rust, making such a reel assembly particularly useful for handling garden or similar hose. Additionally, such a device has great utility when used with collapsible garden hose (consisting of a length of tubing enclosed within a jacket, with fittings on each end of the hose length) where the hose may be flattened while winding for removal of water and to store and transport collapsed hose in minimum space.

A reel assembly embodying the present invention is of novel construction having a pair of members defining spaced apart walls bridging and extending outwardly radially from a central body, the walls and body defining a space for confining a length of wound hose therein. The central body preferably is formed integrally with one of the walls, and is rotatable relative to the other wall for winding up the hose within or for unwinding a wound hose from the confining space on the body. A carrying handle assembly may be arranged on the periphery of the walls, and this handle may also prevent separation of the walls and permit easy winding and unwinding of the hose on the reel.

The wall formed integrally with the central body preferably has grasping means for turning the reel. Preferably, a slit formed in the movable wall inwardly radially from its periphery, adjacent and across the central body, may be adapted for receiving one end of the hose, with its fitting secured in the slit, to hold the hose end during winding.

When fabricating the reel, the first wall and central body section may be formed in one piece and include a peripheral flange over which a portion of the grasping handle is secured during assembly of the reel. The second wall section may have a snap pin centrally thereof which rotatably engages in the central body portion of the first wall and central body section, and the first wall and central body section can be rotated on this second wall portion when the sections are secured together. This second wall section also may have on its periphery a fixed grasping handle portion which during assembly is secured to the other portion of the grasping handle which may be secured over the peripheral flange of the first wall and central body section. Preferably, the first wall and central body section also carries on its periphery means for mounting a handle for rotating the first wall and central body section on the second wall section.

Preferably, the pair of walls may be concentrically aligned and have a plurality of apertures formed therethrough, not only for saving material and making the assembly lighter, but also to permit easy drainage of fluid from the hose during winding and to make the wound material accessible and easier to wind and unwind.

The configuration of the wall and central body sections allows those sections to be interlocked flat and the interlocking portions to be protected from damage during shipment. Likewise, during winding of the hose on the reel, the central body and wall section defining the movable wall and body portion may be secured on a fixture and the hose wound on the body adjacent the wall of its section, without the second wall section being assembled thereto and possibly interfering with rapid winding of the hose. The configuration of the split grasping handle assembly is important, not only because the handle arrangement permits locking of the wall sections together at their peripheries, but also because this grasping handle section includes means for relatively friction free engagement with the wall section flange to provide secured connection of the sections together and still allows free rotation of the movable wall and central body section on the central pin of the other wall section.

The assembly may be easily completed after the hose is wound on the central body, by merely snapping the central body over the wall section pin into the boss of the central body and wall section and joining the grasping handle portions together over the wall flange. Once joined together, the hose and reel assembly is a complete unit ready for shipment, storage and sale, with the hose collapsed in a minimum dimension. Such a compact arrangement may also be maintained by the customer who buys the unit and who and after each use of the hose and reel assembly tightly winds the hose on the reel assembly.

While the reel assembly embodying the present invention is particularly useful in handling lengths of hose, the reel assembly can also be used for handling a great variety of materials, such as lengths of wire, ribbon, rope, chain and other materials which may be repeatedly wound upon and unwound from a reel.

OBJECTS AND ADVANTAGES OF THE INVENTION

It is the object of the present invention to provide a novel reel assembly of the character described.

Another object is to provide a reel assembly having first and second spaced apart wall sections bridging and disposed outwardly radially from a central body, the first wall and body section being movable relative to the second wall section for winding and unwinding a length of material wound thereon.

Another object is to provide a reel assembly which is fabricated from self-lubricating and non-corrodible material.

Another object is to provide a novel split grasping handle assembly for securing the periphery of hose reel sections together.

Another object is to provide a novel grasping handle arrangement having bearing surfaces which are capable of aligning sections of a reel assembly, but do not impede rotation of the reel assembly sections.

Another object is to provide a novel grasping handle and hose reel assembly which has great utility in handling lengths of materials which may be repeatedly wound and unwound.

Another object is to provide a reel assembly which has integral means for holding the fittings of a length of material wound thereon within its central body portion.

Another object is to provide a reel assembly comprised of spaced apart walls for containing a length of wound material therebetween and integral grasping and winding means on said walls.

Another object is to provide a novel hose reel assembly having a movable wall section and means for axially turning said wall section relative to another wall section.

Another object is to provide a wall section for a hose reel assembly having a central body formed integrally therewith with means for holding an end of a length of material therein and upon which said length of material is wound.

Another object is to provide a hose reel fabricated from a pair of concentrically aligned wall sections movable one relative to the other, and having a central body portion for holding a length of material wound thereon.

Another object is to provide a method for easily winding a length of material on a central body and wall section of a reel assembly and for completing said reel assembly by snapping another wall section and grasping handle over said first section after the length of material has been wound thereon.

Another object is to provide a method for joining two sections of a reel assembly together by axially aligning and snap engaging the sections together inwardly radially thereof and by securing the peripheries of said sections spaced apart by a member which is fixed to the periphery of one section and which slidably engages the other section.

Another object is to provide a reel assembly which is easy to manufacture and assemble, and which is economical, efficient and simple to use These and other objects and advantages of the invention will become more apparent as this description proceeds taken in conjunction with the accompanying drawings.

BRIEF DESCRIPTION OF THE DRAWINGS

In the drawings:

FIG. 5 is a plan view of the second wall section and handle portion, with parts of said wall section broken away.

FIG. 6 is a plan view of the portion of the handle to be assembled with the handle portion shown in FIG. 5.

FIG. 7 is an enlarged section view of a part of the handle portion shown in FIG. 6, taken on line 7—7 of FIG. 6.

FIG. 8 is an enlarged plan view of a channel member which may be formed on the first wall section for holding a turning handle useful in rotating said section relative to a second wall section.

FIG. 9 is a section view taken on line 9—9 of FIG. 8.

FIG. 10 a plan view showing a preferred turning handle for use with the channel member shown in FIGS. 8 and 9, with its channel slits used in securing it to the channel member shown in broken lines.

FIG. 11 is a side elevational view of the preferred turning handle shown in FIG. 10.

DESCRIPTION OF A PREFERRED EMBODIMENT REEL STRUCTURE

Figure 1:
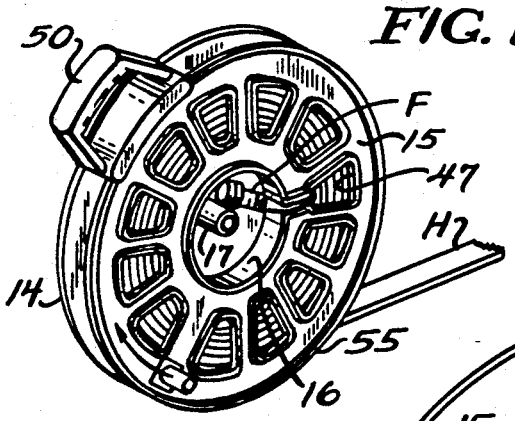
FIG. 1 is a perspective view of a reel assembly embodying the present invention having a length of material wound thereon.
Figure 2:
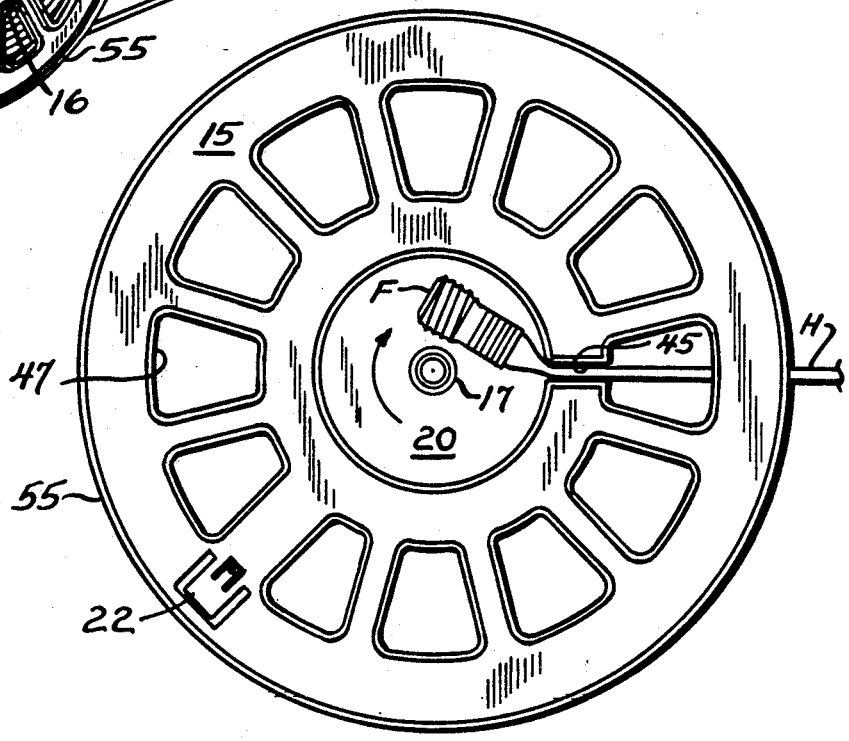
FIG. 2 is an elevational view showing one side of the reel assembly.

In the preferred embodiment shown in the accompanying drawings, a length of material H, such as collapsible garden hose, having connection fittings F, usually one on each end thereof, is wound on the reel. The reel has space apart walls 14 and 15 bridging and extending outwardly radially from a central body 16. The center of the central body 16 is formed on one wall 15 with an apertured inwardly extending boss 17, and the other wall 14 has a shaft 18 of lesser diameter than the boss 17, so that it fits therein, and is of greater length than said boss 17 so that the shaft 18 is suitable for snap engagement in the boss 17 with its split lip 19 at the free end of the shaft 18 snap fit over the boss end.

The central body 16 also has a wall 20 spaced outwardly radially from the boss 17, angularly disposed from which projects a bearing ring 21. This wall 20 is adapted to bear against the central portion of the wall 14, providing a smooth track for easy turning of the side walls 14 and 15 relative to one another.

At the periphery of the wall 15 are channels 22, arranged for receiving the slotted base 30 of a handle member 31. Preferably, the edges of the base 30 have a groove 33, and the channel 22 has a shoulder 34 dimensioned to accommodate the base groove 33, permitting the handle to be inserted into and removed from the channel 22. Preferably, the channel 22 in wall 15 and the base 30 have cooperating projections 40 for urging the handle 31 into proper secured position, acting as a detente holding the base 30 against unintended removal from the channel 22.

The wall 15 has a slit 45, which extends into the central body 16 for receiving the fitting F of the hose H therein, and which holds the hose in position for winding. Preferably, both side walls 14 and 15 have spaced outwardly radially from their centers a series of drain holes 47, which enhance quick drying of woven fabric arranged on the reel, and also make the layers of hose H available for manipulation during winding.

The grasping handle assembly 50 is of novel construction, in that one handle part 51 may be formed on the periphery of and unitary with one wall member 14, and this first handle part 51 has cooperating means for securing it to the other or second handle part 52, such as posts 53 on one handle part and sockets 54 for accommodating such posts on the other handle part. The other wall section 15 has a continuous peripheral flange 55, and the second handle part 52 has a depending wall 56 and bearing members 57 adapted to contain the flange 5 when the handle parts are assembled together. Each of these bearing members 57 is relatively short so that they will not bind the wall member 15 as it is turned on the other or first wall member 14 and its central shaft 18 during winding and unwinding of the reel.

METHOD OF LOADING REEL

Figure 3:
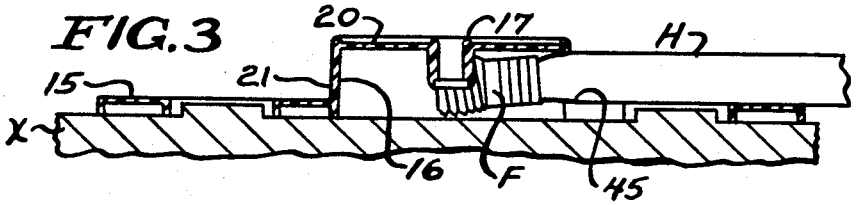
FIG. 3 is a sectional view showing the first wall and central body section of the reel assembly mounted on a fixture for winding a length of hose thereon during fabrication.
Figure 4:
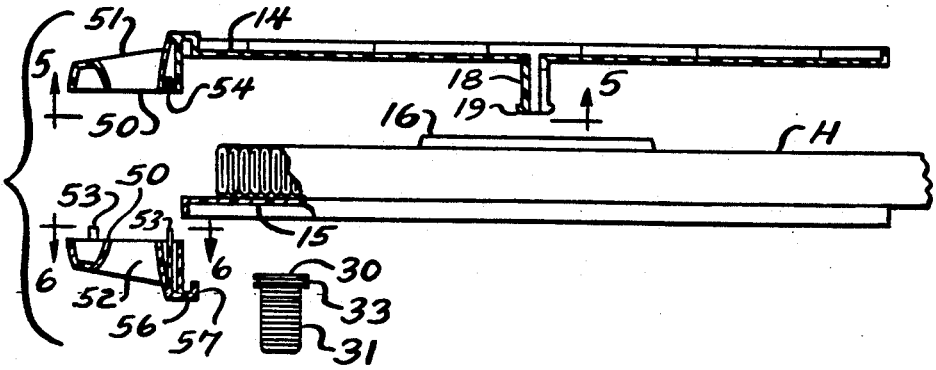
FIG. 4 is an orthogonal view of the reel assembly showing the sections which are assembled together, with a length of material wound thereon.

The reel is structured so that it can be loaded in a novel manner at the time of the manufacture of the hose or other length of material to be wound upon it. As shown in FIG. 3, the integral wall member 15 and central body member 16 are mounted on a fixture X, with the fitting F of the length of hose H or other material engaged within the slot 45. The fixture X is then turned, or the hose H is manipulated around the central body 16, to wind the hose on the bearing ring 21. When the hose is fully wound, as shown in FIG. 4, the wall member 14 is brought down over the wall section 15, so that the shaft 18 and its lip 19 engages with boss 17, and the second handle part 52 is then assembled with the first handle part 51, by pressing the posts 53 into their corresponding sockets 54, with its bearing ring 57 engaged over the peripheral flange 55 on wall section 15.

USING THE REEL ASSEMBLY

In use, the handle 31 may be mounted in the channel 22 on the wall section 15, extending outwardly therefrom. The user may wind or unwind the length of material H from the central body 16, by merely holding the handle assembly 50 with one hand, and turning the handle 31 in an appropriate direction with the other hand. As the handle 31 is turned, the wall section 15 and the central body 16 is rotated on the other wall section 14 until the length of hose is fully wound or exhausted. During winding, while the lengths of material H are wound on one another, water in the hose is pressed from it as each layer of hose is wound on the layer beneath it, causing the hose to be collapsed flat, permitting the wound reel assembly to be stored in minimum space. With the handle 31 removed, both sides of the assembly are relatively flat, allowing like wound reel assemblies to be stacked in minimum space for transport and storage.

Because there is minimum frictional binding between the wall sections 14 and 15, the length of hose H or other material may also be unwound for use by merely laying the free end fitting F on the ground and walking the hose along its intended path, dragging the reel to allow the wall sections to move relative to one another by gravity to unwind the hose.

Should dirt or foreign matter become lodged between the wall sections 14 and 15 or central body 16, these parts may be separated by merely pinching the lip 19 and backing the shaft 18 away from the boss 19. Removal of wound hose from the reel assembly may also be accomplished in the manner described in the previous sentence, with the exception that upon separation of the parts, the fitting F must be threaded through the slot 45 for freeing the hose H from the reel assembly. Reconnection of the sections may be accomplished by merely reversing the separation steps discussed in this paragraph.

Having thus described the invention in considerable detail, it is apparent that many changes and modifications may be made in the structure described without departing from the spirit or scope of the intention. It is not desired that the invention should be limited to the exact construction described.

I claim:

1. A reel assembly for winding, storing and transporting a length of material, said reel assembly comprising: a pair of spaced apart walls, a central body bridging and disposed inwardly radially from the periphery of said walls, said walls and body defining a channel open from the periphery of said walls for confining said length of material therein when wound on said body, grasping means on the periphery of said walls for holding said assembly and maintaining said walls in spaced apart relation at their peripheries, a first of said walls and said body being rotatable relative to said grasping means and adapted for rotation in one direction for winding up said length of material on said body and in a reverse direction for unwinding said length of material from said channel, cooperating means on said grasping means and on the periphery of said first wall permitting free movement of said first wall relative to said grasping means during such rotation, said body and said first wall having receiving means opening from a free edge of said first wall for entry and securing of one end of said length of material within said channel, said walls having bearing members engaged at their centers spaced inwardly radially from said body for low friction securement of said walls together.

2. The reel assembly recited in claim 1, wherein said walls have a plurality of drain holes arranged therethrough in communication with said channel.

3. The reel assembly recited in claim 1, wherein said reel is fabricated from plastic material having low friction characteristics.

4. The reel assembly recited in claim 1, wherein said first wall and said central body are formed in one piece.

5. The reel assembly recited in claim 1, wherein said bearing members have has an inner annular boss.

6. The reel assembly recited in claim 5, wherein one of said walls has an inner annular shaft concentrically aligned with said boss.

7. The reel assembly recited in claim 6, wherein said shaft has a free end which extends through said boss.

8. The reel assembly recited in claim 7, wherein the free end of said shaft has a lip adapted to snap engage over said boss when said walls are brought together.

9. The reel assembly recited in claim 1, wherein said grasping means comprises a handle assembly, a first part of which is integral with one of said walls.

10. The reel assembly recited in claim 9, wherein a second part of said handle assembly is removably secured to said first handle part.

11. The reel assembly recited in claim 10, wherein said cooperating means comprises a flange on the periphery of one of said walls slidably interlocked with said second handle part.

12. The reel assembly recited in claim 11, wherein said second handle part has a depending wall slidably engaging said flange.

13. The reel assembly recited in claim 12, wherein said depending wall carries a bearing member intermittently touching said one of said walls.

14. The reel assembly recited in claim 10, wherein said handle assembly parts have cooperating post and socket means for securing said parts together.

15. The reel assembly recited in claim 1, wherein said rotatable wall has a turning handle removably secured thereto arranged away from the other of said wall spaced inwardly radially from the periphery of said first wall.

16. The reel assembly recited in claim 1, wherein the surfaces of each of said walls on a side opposed to said confining channel are flat and parallel to one another, and like reel assemblies are adapted for stacking on one another, the wall surface of each of said like reel assemblies being adapted for arrangement in face to face relation with one another.

* * * * *